US006240866B1

(12) United States Patent
Nakatsuji

(10) Patent No.: US 6,240,866 B1
(45) Date of Patent: Jun. 5, 2001

(54) ANTI-VIBRATION STRUCTURE FOR WATERCRAFT WITH STRADDLE TYPE BENCH SEAT

(75) Inventor: Akira Nakatsuji, Shizuoka (JP)

(73) Assignee: Yamaha Hatsudoki Kabushiki Kaisha (JP)

( * ) Notice: Subject to any disclaimer, the term of this patent is extended or adjusted under 35 U.S.C. 154(b) by 0 days.

(21) Appl. No.: 09/351,138

(22) Filed: Jul. 12, 1999

(51) Int. Cl.[7] ..... B63B 35/73
(52) U.S. Cl. ..... 114/55.57; 114/55.5
(58) Field of Search ..... 114/55.5, 55.53, 114/55.55, 55.57

(56) References Cited

U.S. PATENT DOCUMENTS 5,234,364 * 8/1993 Ito ..... 114/55.5
5,446,250 * 8/1995 Oka ..... 181/208

FOREIGN PATENT DOCUMENTS

403193587 * 8/1991 (JP) ..... 114/55.5

* cited by examiner

*Primary Examiner*—Stephen Avila
(74) *Attorney, Agent, or Firm*—Bacon & Thomas PLLC

(57) ABSTRACT

A watercraft includes a plastic hull and a plastic deck which are joined together in a vertical direction. An upwardly extending portion on a part of the deck defines a seat platform at its top side. A straddle type seat for a rider is installed upon the seat platform. A discrete layer of vibration damping material is attached to opposed side walls of the seat platform. A discrete layer of auxiliary vibration damping material is attached to opposed side plates of the hull. The discrete layers of vibration damping material and the auxiliary vibration damping material damp vibrations from a propulsion apparatus, which propels the watercraft through water, and thus increasing the rider's comfort.

7 Claims, 4 Drawing Sheets

ANTI-VIBRATION STRUCTURE FOR WATERCRAFT WITH STRADDLE TYPE BENCH SEAT

BACKGROUND OF THE INVENTION

1. Field of the Invention

The present invention relates to an anti-vibration structure for small watercraft equipped with a straddle type seat located on an upwardly extending portion of the deck of the watercraft.

2. Description of the Related Art

Conventionally, such a watercraft is of the following structure. The body of the watercraft consists of a lower hull member and an upper deck member made of plastic which are joined together vertically. An upwardly extending portion is formed in a part of the deck member which serves as a platform for a straddle type seat.

The watercraft is equipped with a propulsion apparatus that propels the watercraft. This propulsion apparatus is located inside the watercraft body and includes an internal combustion engine mounted to a bottom panel of the hull member. In addition, a jet generator is mounted at the stern of the watercraft. The jet generator is linked to the internal combustion engine by a propulsion shaft.

When the internal combustion engine is running, the power output of the internal combustion engine is transmitted to the jet generator. This causes the jet generator to discharge a jet of water rearward from the watercraft. Water resistance against this jet of water propels the watercraft forward. Also, during this propulsion, a rider straddling the seat forward of the jet may steer the watercraft in a desired direction.

In conventional watercraft of this type, wherein the internal combustion engine is supported on the hull member, vibrations from the engine are transmitted to the deck member, to the seat platform and to the rider. This transmission of vibrations to the rider through the seat detracts from riding comfort while seated.

Further, when the watercraft is turned sharply, the seated rider will often strongly clamp both legs inwardly to hold himself in place. If the seat platform is not strong enough, the pressure applied by the rider's legs may cause it to deform, which also may detract from riding comfort.

SUMMARY OF THE INVENTION

The present invention provides an anti-vibration structure for watercraft having a straddle type seat.

One embodiment of the anti-vibration structure according to the present invention provides an improved watercraft with a straddle type seat, the watercraft including a plastic hull and a plastic deck that are joined together in a vertical direction, a portion of the deck rising upwardly to form a seat platform, wherein the improvement comprises a discrete layer of vibration damping material affixed to each of the upright side walls of the seat platform.

Another embodiment of the anti-vibration structure according to the present invention provides an improved watercraft with a straddle type seat wherein the vibration damping materials is are affixed to an inner surface of each of the seat platform side walls.

Still another embodiment of the anti-vibration structure according to the present invention provides an improved watercraft with a straddle type seat wherein auxiliary the vibration damping material is affixed to inner surfaces of side walls of the hull at a longitudinal position approximately the same as the straddle type seat position, that is, in the fore-aft direction.

BRIEF DESCRIPTION OF THE DRAWINGS

A detailed description of a preferred embodiment is provided below, as an example and without limiting the scope of the invention in any way, with reference to the appended drawings, in which.

DETAILED DESCRIPTION OF THE PREFERRED EMBODIMENT

Figure 1:
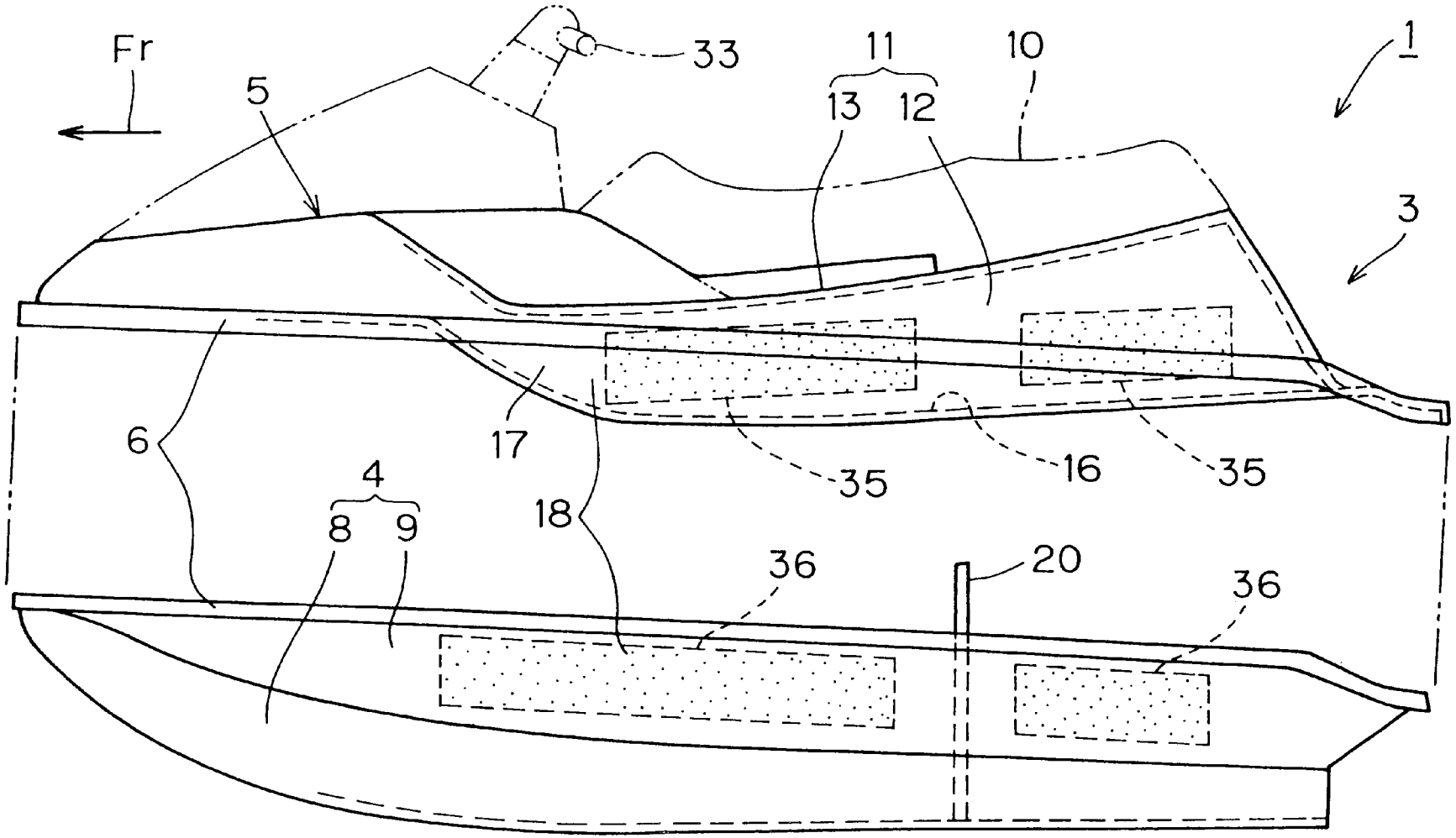
FIG. 1 is a side elevation exploded view of an improved watercraft according to the present invention, before assembly of the deck and hull.
Figure 2:
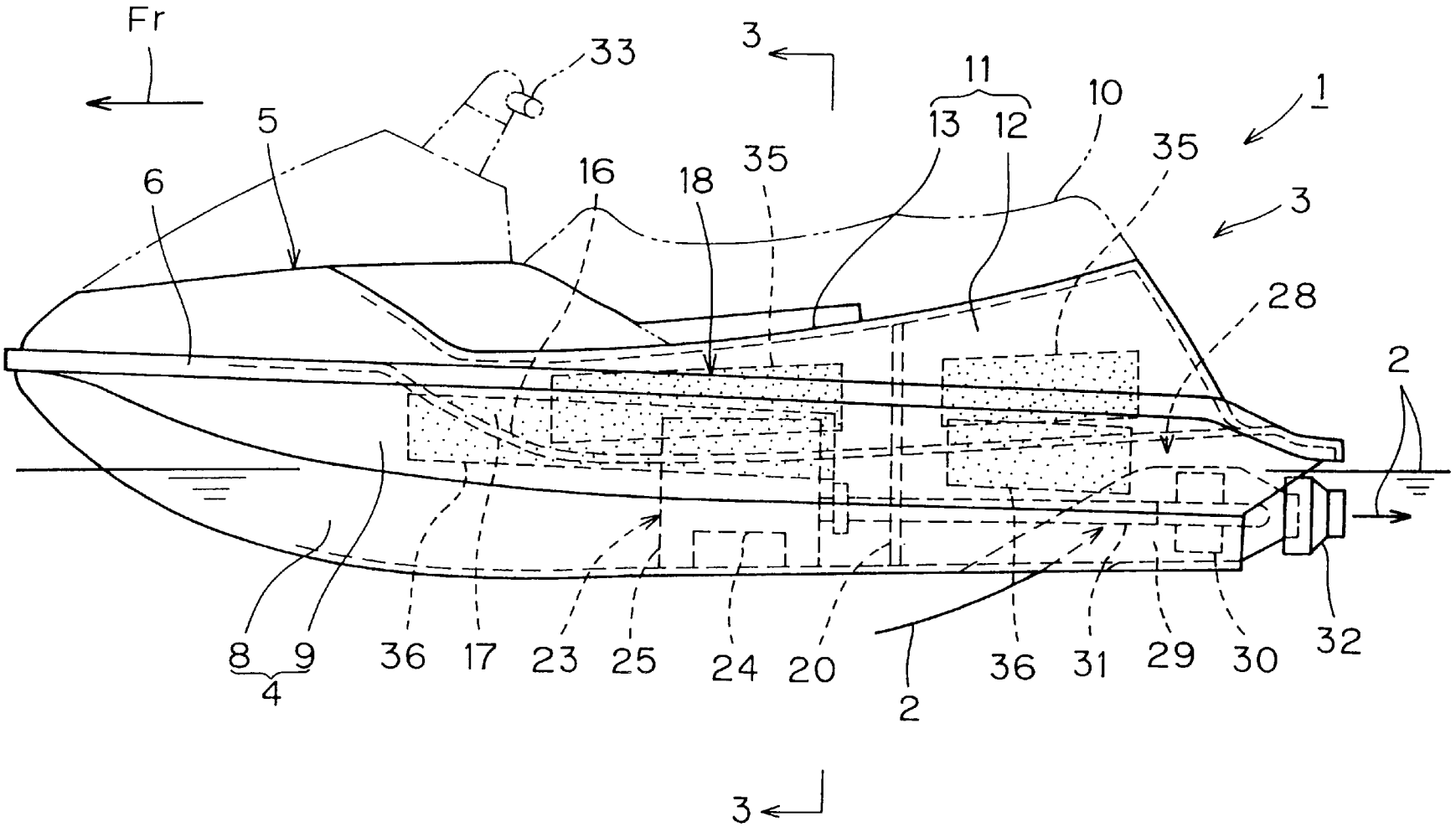
FIG. 2 is a side elevation view of the watercraft after assembly.
Figure 3:
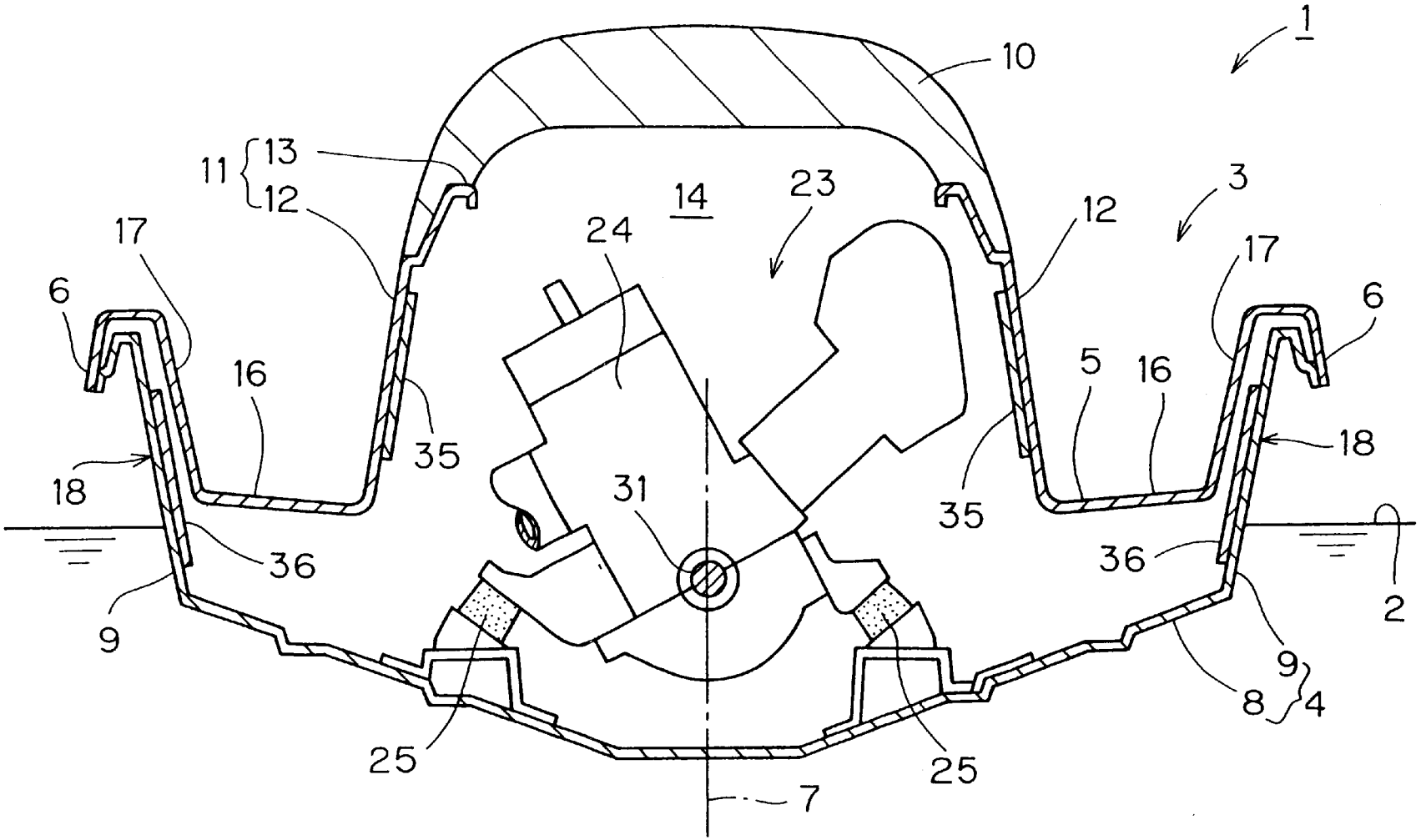
FIG. 3 is a sectional view along line 3—3 of FIG. 2 showing the mounting of the engine in the hull; and, FIG. 4 is an enlarged view of a cut-away portion of the left side of FIG. 3.
Figure 4:
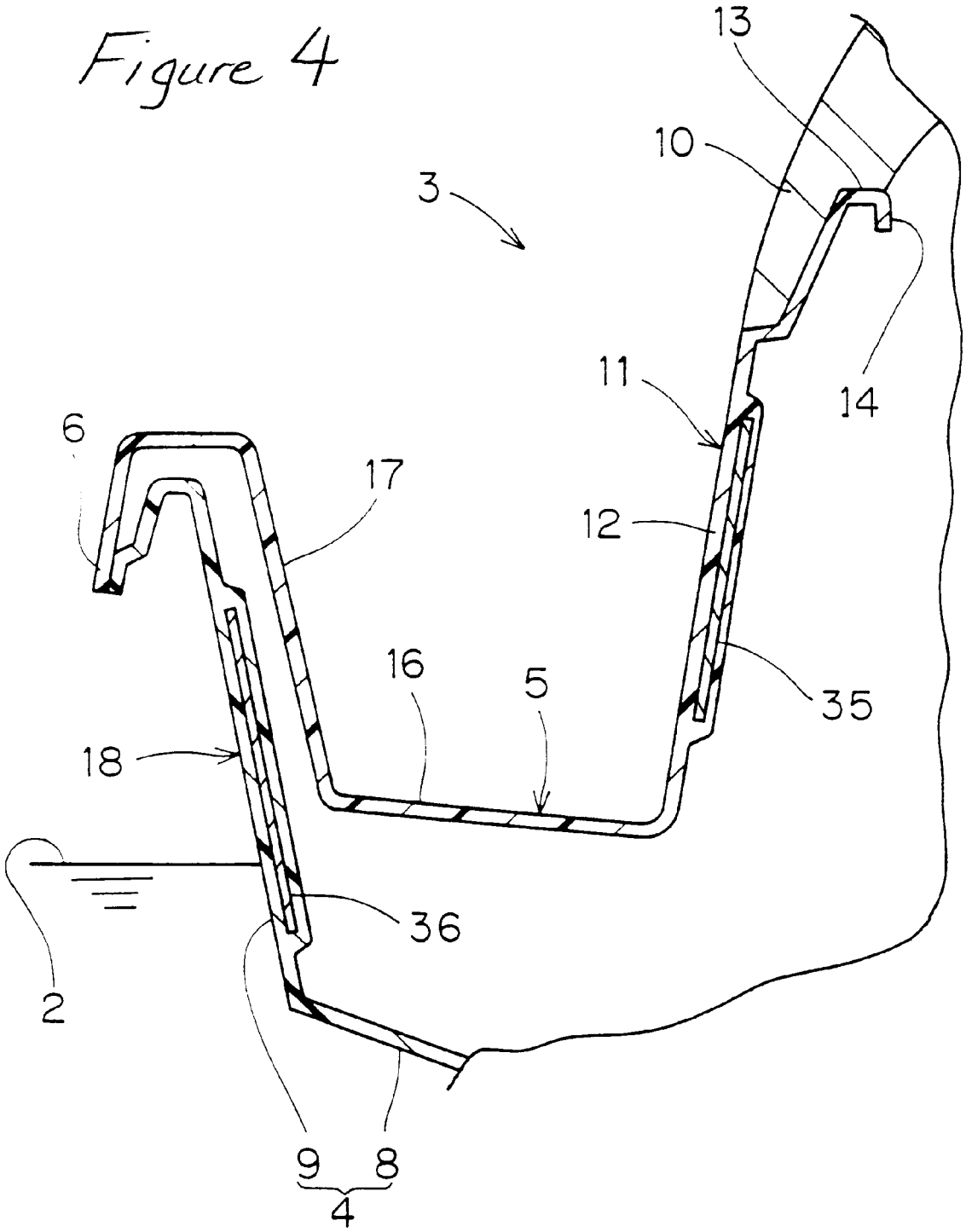

In the figures, a small watercraft 1 having a straddle type seat (or, in other words, a saddle type seat) is designed to float on water surface 2. Arrow Fr shows the direction of forward propulsion of the watercraft 1, and references to left and right below will mean left and right across the watercraft 1 in the transverse directions with respect to the forward propulsion direction.

The watercraft 1 is a planing type of watercraft; in other words, it glides over the surface of the water 2 with its bow tilted at a slight upward angle at an approximately constant attitude, and is capable of being propelled at high speeds. Due to strength requirements, a body 3 of the watercraft 1 is made from fiber reinforced plastic (FRP) and composed of a lower hull 4 and an upper deck 5 which are joined vertically, with the deck 5 atop the hull 4. A gunnel is formed in this junction area.

The hull 4 has a hull plate 8 that slopes upward from a transverse center of the body 3 at a gradual angle and then extends upward until an outside edge of the hull plate extends nearly perpendicularly.

On the other hand, in the transverse center of the deck 5 there is an upwardly extending portion that forms a seat platform 11 upon which a detachable straddle type bench seat 10 is mounted. The seat 10 and seat platform 11 extend over a considerable length in the fore-aft direction. A rider sits forward, straddling the seat. The seat platform 11 has two upright side walls 12, left and right, that extend approximately perpendicularly. These left and right side walls 12 have an integrally formed top plate 13 that are connected peripherally to form the seat platform 11. The seat 10 may be removably mounted on a top surface of this top plate 13. Preferably, an opening 14 is formed in the top plate 13 which connects the inside of the watercraft body 3 with the outside. The opening 14 may be opened/closed by the removal/replacement of the seat 10.

Footrests 16 are formed around the left and right sides of the deck 5. These footrests 16 integrally extend outward from a bottom edge of the seat platform side walls 11, and may be used by the rider to rest his feet while sitting on the seat 10.

An outer edge of the footrests 16 extends upward, nearly perpendicularly, and forms a side plate 17 of the deck 5. An upper edge of a side plate 9 of the hull 4 is joined to an upper edge of the deck side plate 17 to form the aforementioned gunnel. In addition, the hide side wall 9 and the deck side plate 7 are slightly separated to constitute a bulwark 18.

There is a partition wall (bulkhead) 20 inside the body 3 that divides it fore and aft. The bulkhead 20 is rigidly joined to both the hull 4 and the deck 5. Its location in approximately the fore-aft center of the body 3 serves to increase strength and rigidity.

The body 3 is equipped with a propulsion apparatus 32 that propels it through the water 2. The propulsion apparatus 32 includes an internal combustion engine 24 that is mounted forward of the bulkhead 20 in the body 3 of the watercraft 1. The internal combustion engine 24 is mounted along a centerline 7 of the body 3 of the watercraft 1 in the transverse direction (left-right direction), and it is mounted to the hull panel 8 on resilient rubber shock absorbing mounts 25. In this case, the internal combustion engine 24 is positioned directly beneath the opening 14; thus, opening 14 allows access to the internal combustion engine 24 from outside the body 3 for maintenance and inspection.

A jet generator 28 is located rearward of the bulkhead 20 at the stern of the watercraft 1. The jet generator 28 includes a water passage 29 that is beneath the stern of the body 3. An impeller 30 is contained within the water passage 29. The impeller 30 is driven by a propulsion shaft 31 linked to the internal combustion engine 24.

A rudder pipe 32 aft of the water passage 29 is movably mounted to the stern of the body 3. Handlebars 33 for steering the watercraft 1 are supported in front of the seat 10, and movement of the handlebars 33 is linked to movement of the rudder pipe 32. The rider seated on the seat 10 may grasp these handlebars 33.

Power from the internal combustion engine 24 is transmitted through the propulsion shaft 31 to drive the impeller 30 of the jet generator 28. When the impeller 30 is so rotated, water 2 inside the water passage 29 is jetted rearward from the body 3, and resistance against this jet propels the watercraft 1 forward. The watercraft 1 may be steered in the desired direction by turning the handlebars 33 to change the direction of the rudder pipe 32.

The internal combustion engine 24, the jet generator 28, the seat 10 and seat platform 11 are positioned to be aligned in the fore-aft direction. In other words, they are positioned approximately the same in the fore-aft directions. The internal combustion engine 24 and the jet generator 28 each generate vibrations when they are driven. These vibrations may be transmitted successively through the seat platform 11 and to the seat 10 where they are transmitted to the rider (or tandem riders). Furthermore, these vibrations are readily transmitted from the internal combustion engine 24 and the jet generator 28 to the large flat surfaces such as the hull side walls 9 and the deck side plates 17, respectively, as well as the seat platform side walls 12, because of their flexibility, even before they are transmitted to the seat 10.

According to the present invention, auxiliary a discrete layer of vibration damping material is glued to the hull side walls 9 both fore and aft. Specifically, the second vibration material is affixed to inside surfaces thereof. Left and right pairs of vibration damping material 35 is glued to inner surfaces of the seat platform side walls 12 such that the second layer of vibration damping material 36 is intersected by a generally horizontally extending imaginary plane that also intersects at least a portion of the first vibration damping material 35. The vibration damping material 35, 36 serves to effectively damp vibrations transmitted to the rider. What is meant by fore and aft locations for the vibration damping material 35 and the auxiliary vibration damping material 36 is both in front of and behind the bulwark 20. In other words, the installation of the vibration damping material 35, 36 is on either side of the bulwark 20, which itself is rigid enough to inhibit vibrations. The first damping material is located at a longitudinal position along the seat platform side walls 12 so that it is located beneath the opening 14.

The vibration damping material 35, 36 is preferably made of resilient rubber panels. When gluing them on, the surfaces of the vibration damping material 35, 36 is coated with an activator (urethane primer) to improve adhesion, and the vibration damping material 36 is affixed to the seat platform side walls 12 and hulls side walls 9 using a hot resin glue spray which cures to be held in place.

Since vibration damping material 35 is glued to the upright seat platform side wall 12 in the foregoing structure, vibrations from the internal combustion engine 24 and the jet generating means 28 that are transmitted through the seat platform 11 to the seat 10, where the driver is sitting, are damped by the vibration damping material 35.

Further, the gluing of vibration damping material 35 to the seat platform side walls 12 increases the rigidity of the seat platform side walls 12, which prevents their deformation when strongly clamped by the rider's legs when making sharp turns, etc.

Further still, by gluing the vibration damping material 35 to the inside, surfaces of the seat platform side walls 12, the vibration damping material 35 will not interfere with the rider's legs.

In addition, by gluing the auxiliary vibration control material 36 on the inside surfaces of the hull side wall 9 in approximately the same fore-aft position as those in the seat platform 11, the vibrations transmitted from the hull 4 to the seat platform 11 are damped by the auxiliary vibration damping material 36.

Moreover, since the vibration damping material 36 is glued to the inside surfaces of the hull side walls 9, the vibration damping material 36 does not protrude outside the hull 4. Thus, they do not create propulsion drag in the water 2 and smooth propulsion is achieved since the watercraft 1 may be propelled smoothly without any resistance against the water 2 from the vibration damping material 36.

It will be understood that various modifications may be made to the preferred embodiment in accordance with principles known to those skilled in the art. The scope of the invention is not to be limited by the described embodiment, but rather only by the scope of the appended claims.

I claim:

1. In an anti-vibration structure for a watercraft including a plastic hull having longitudinally extending side walls and a plastic deck which are joined together in a vertical direction and form a gunwale having a generally horizontally extending top edge, wherein a part of the deck extends upwardly to form a plurality of upright side walls defining a seat platform that forms an opening upon which a straddle type seat is disposed, the improvement comprising:

a first vibration damping material affixed to a surface of at least one of said seat platform side walls located at a longitudinal position in the side walls located beneath the opening and at least a part of the first damping material located so that it is intersected by a first imaginary generally horizontal plane including the top edge of the gunwale; and a second vibration damping material affixed to inner surfaces of said hull side walls at a longitudinal location on the hull where it is intersected by a second generally horizontal imaginary plane that also intersects a portion of the first damping material.

2. The improvement in an anti-vibration structure for a watercraft according to claim 1, wherein the first and second damping material comprise resilient rubber panels.

3. The improvement in an anti-vibration structure for a watercraft according to claim 1, wherein the first and second damping material comprise composite reinforced damping panels.

4. The improvement in an anti-vibration structure for a watercraft according to claim 1, wherein one side of said first and second damping material is affixed to one side of said inner surfaces of said seat platform side walls and of said hull, respectively, and a layer of plastic is affixed to the other side of said vibration materials covering said first and second damping material on said inner surfaces.

5. The improvement in an anti-vibration structure for a watercraft according to claim 1, wherein the first damping material is affixed to transversely opposed ones of said seat platform side walls.

6. The improvement in an anti-vibration structure for a watercraft according to claim 2, wherein the first damping material is affixed on inner surfaces of said seat platform side walls.

7. The improvement in an anti-vibration structure for a watercraft according to claim 3, wherein the first damping material affixed to the seat platform side walls and the second damping material affixed to the hull side walls are adhered to opposed ones of said seat platform side walls and inner surfaces of opposed hull side walls, respectively.

* * * * *